US011246368B2

(12) United States Patent
Hwang et al.

(10) Patent No.: US 11,246,368 B2
(45) Date of Patent: Feb. 15, 2022

(54) PROTECTIVE HELMET AND OPENING FOR SECURING THE HELMET

(71) Applicant: Thousand, LLC, Los Angeles, CA (US)

(72) Inventors: Gloria Hwang, Los Angeles, CA (US); John Larkin, Moscow, ID (US)

(73) Assignee: THOUSAND, LLC, Los Angeles, CA (US)

( * ) Notice: Subject to any disclaimer, the term of this patent is extended or adjusted under 35 U.S.C. 154(b) by 609 days.

(21) Appl. No.: 14/932,517

(22) Filed: Nov. 4, 2015

(65) Prior Publication Data

US 2016/0135534 A1 May 19, 2016

Related U.S. Application Data

(60) Provisional application No. 62/075,832, filed on Nov. 5, 2014.

(51) Int. Cl.
*A42B 3/04* (2006.01)
*A42B 3/28* (2006.01)

(52) U.S. Cl.
CPC ..... *A42B 3/0413* (2013.01); *A42B 3/283* (2013.01)

(58) Field of Classification Search
CPC ... E05B 73/0005; E05B 67/003; B62J 11/005; A42B 3/04; A42B 3/28; A42B 1/24
USPC .... 2/422, 171.3, 420, 414; 70/367, 57.1, 59; 220/375
See application file for complete search history.

(56) References Cited

U.S. PATENT DOCUMENTS 3,335,720 A * 8/1967 Aileo ..... A61F 11/14 128/866
3,436,936 A * 4/1969 Locker ..... A42B 3/0413 70/59
3,496,854 A 2/1970 Feldmann et al.
3,529,451 A * 9/1970 McOsker ..... B62J 11/005 2/422
3,646,786 A * 3/1972 Baker ..... A42B 3/0413 70/59
3,797,040 A * 3/1974 Caldwell ..... A42B 3/166 2/421
3,798,934 A * 3/1974 Wright ..... A42B 3/0413 119/795
3,925,821 A 12/1975 Lewicki
4,054,953 A 10/1977 De Barsy
(Continued)

FOREIGN PATENT DOCUMENTS

CN 202608939 U 12/2012
DE 102012211946 A1 1/2014
(Continued)

OTHER PUBLICATIONS

Top: https://www.merriam-webster.com/dictionary/top.*
(Continued)

*Primary Examiner* — Jillian K Pierorazio
(74) *Attorney, Agent, or Firm* — Duane Morris LLP; Manita Rawat

(57) ABSTRACT

A helmet comprises a protective shell shaped to protect a head of a user. The protective shell has an exterior surface, an interior surface, and at least on one opening extending from the exterior surface to the interior surface. At least one detachable cap is sized and shaped to fit the at least one opening.

20 Claims, 16 Drawing Sheets

(56) References Cited

U.S. PATENT DOCUMENTS 4,274,271 A * 6/1981 Todd ..... A42B 3/0413 70/19
4,434,514 A * 3/1984 Sundahl ..... A42B 3/281 2/171.3
4,612,675 A 9/1986 Broersma
4,621,441 A * 11/1986 Wagner ..... G09F 3/00 36/1
4,676,080 A * 6/1987 Schwarz ..... E05B 73/0005 70/49
4,744,106 A * 5/1988 Wang ..... A42B 3/286 2/171.3
4,747,511 A * 5/1988 Dutt ..... B65D 17/506 220/254.1
5,337,421 A * 8/1994 Jeng ..... A42B 3/066 2/171.3
5,450,631 A * 9/1995 Egger ..... A42B 3/066 2/171.3
5,664,444 A * 9/1997 Schaan ..... A42B 3/0413 70/14
6,061,834 A * 5/2000 Liao ..... A42B 3/283 2/171.3
6,154,887 A * 12/2000 Yagi ..... A42B 7/00 2/175.6
6,263,513 B1 * 7/2001 Murakami ..... A42B 3/0493 2/171.3
6,425,143 B1 * 7/2002 Benedict ..... A42B 3/24 2/171.3
6,904,618 B2 6/2005 Musal
7,865,976 B2 1/2011 Ambuske et al.
8,776,272 B1 7/2014 Straus et al.
2005/0283885 A1 * 12/2005 Stroud ..... A42B 3/062 2/411
2008/0023478 A1 * 1/2008 Cahill ..... B65F 1/16 220/375
2012/0260403 A1 * 10/2012 Hardy, III ..... A42B 3/16 2/244
2015/0000012 A1 * 1/2015 Ikeda ..... A42B 3/281 2/411

FOREIGN PATENT DOCUMENTS

EP 2338365 A1 6/2011
WO 2005006900 A2 1/2005
WO 2007041656 B1 6/2007
WO 2014170285 A1 10/2014

OTHER PUBLICATIONS http://www.giro.com/us_en/products/men/helmets/urban/sutton-24424.html, 2014.
http://www.fuseproject.com/work/nyc/helmet/?focus=product, 2009.
Federal Register,vol. 63, No. 46, Consumer Product Safety Commission, Part II, 16 CFR Part 1203, Safety Standards for Bicycle Helmets, Final Rule, Mar. 10, 1998, pp. 11711-11747.
De Bruyne, Guido, Heat Loss Of The Human Head Under Bicycle Helmets For Designing Safer Bicycle Helmets, Lazer Sport, K. U. Leuven Bicycle Helmet Research Group,pp. 1-52, 2012.

* cited by examiner

PROTECTIVE HELMET AND OPENING FOR SECURING THE HELMET

This application claims the benefit of U.S. Provisional Patent Application No. 62/075,832, filed Nov. 5, 2014, which is incorporated by reference herein in its entirety.

TECHNICAL FIELD

This disclosure relates generally to protective helmets.

BACKGROUND

Helmets are designed to protect a user's head. In order to increase the likelihood that a user will wear a helmet, a helmet should be comfortable to wear. For example, a helmet should allow airflow to the user's head. Additionally, helmets should fit comfortably, should be light weight, and should not obstruct visibility.

Further, helmets may restrict air flow to the user's head, which may cause a user's head to reach uncomfortable temperatures. Some helmets have ventilation slots which allow air to incidentally enter the vents if external airflow and the ventilation slots align. Improved helmet designs are desired.

SUMMARY

In some embodiments, a helmet comprises a protective shell shaped to protect a head of a user, the protective shell having an exterior surface, an interior surface, and at least on one opening extending from the exterior surface to the interior surface, and at least one detachable cap sized and shaped to fit the at least one opening.

In some embodiments, a helmet comprises a protective shell shaped to protect a head of a user. The protective shell has an exterior surface, an interior surface, at least on one opening, at least one top vent at a top of the protective shell and at least one rear vent at a rear end of the protective shell. The opening, the top vent and rear vent each extend from the exterior surface to the interior surface. The interior surface has at least one channel therein extending from the top vent to the rear vent or the rear end of the protective shell. At least one detachable cap is sized and shaped to fit the at least one opening. A tether is attached to the cap and the protective shell, for retaining the cap near the opening when the cap is detached from the opening. An air scoop is attached to the protective shell above the top vent.

In some embodiments, a method comprises: attaching a first end of a tether to a helmet having a lock port opening therein; and attaching a second end of the tether to a cap that is sized and shaped to fit the lock port opening, so that the cap and the lock port opening are detachably attachable to each other.

DETAILED DESCRIPTION

Helmets can be difficult to secure when they are not being worn. For example, a user may either carry the helmet after use or attach it to a fixed object using the helmet's straps. Carrying the helmet when the helmet is not being worn may be inconvenient, but attaching the helmet to a fixed object using the helmet's straps may not adequately deter theft.

This disclosure relates to a protective helmet 10 for protecting a user's head from impact (e.g., during a fall) and/or from being struck by any external objects, such as a low-hanging tree branch. In some embodiments, the protective helmet 10 further includes a mechanism (e.g., a lock port) for securing the helmet to a fixed object when the helmet is not being used. In some embodiments, the protective helmet includes one or more vents and one or more air scoops to facilitate air flow through the helmet.

A helmet that protects a user from impact and the elements is described herein. In some embodiments, the helmet configuration is convenient to handle or store when the helmet is not being worn. In some embodiments, the helmet provides temperature regulation.

FIGS. 1A to 4D and 9A-9C illustrate an exemplary embodiment of a helmet 10 suitable for use while cycling. The helmet 10 includes a protective shell 1 with at least one opening (also referred to as a lock port) 2 in the protective shell, and a cap (also referred to as a lock port cover) 3, for covering the opening 2.

Figure 1A:
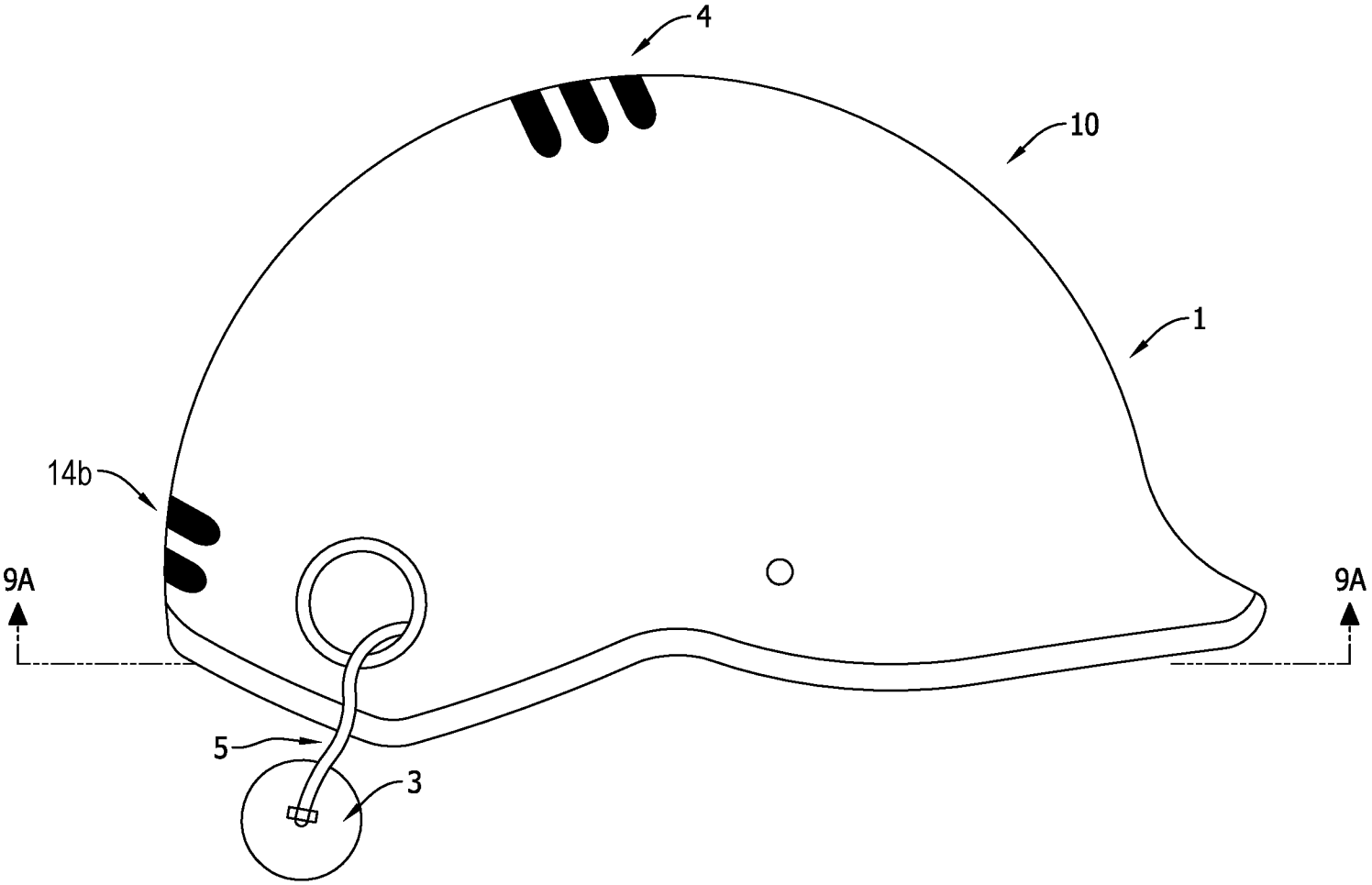
FIG. 1A illustrates a side view of an exemplary embodiment of a helmet having an opening and a detachable cap.
Figure 1B:
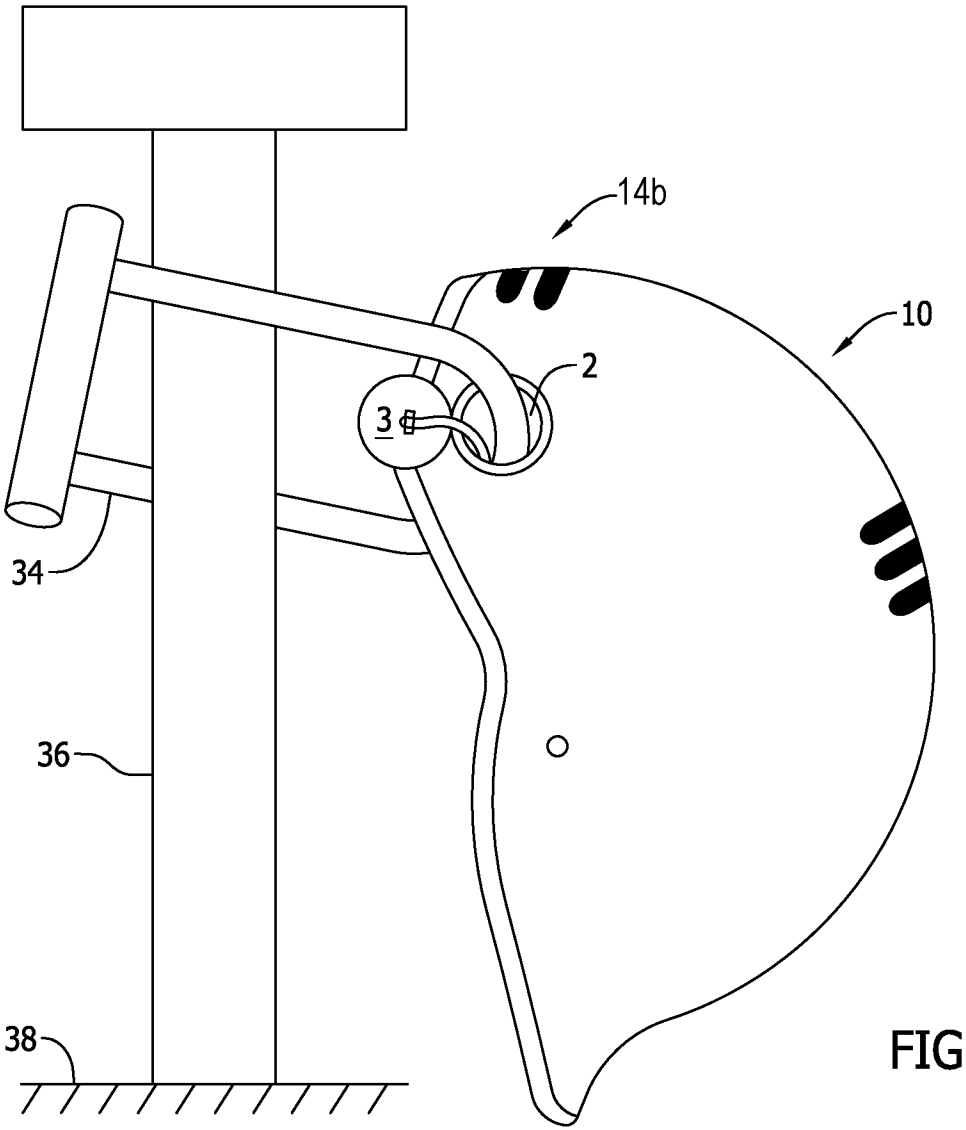
FIG. 1B shows the helmet of FIG. 1A, attached to a stationary post by a U-lock.
Figure 2:
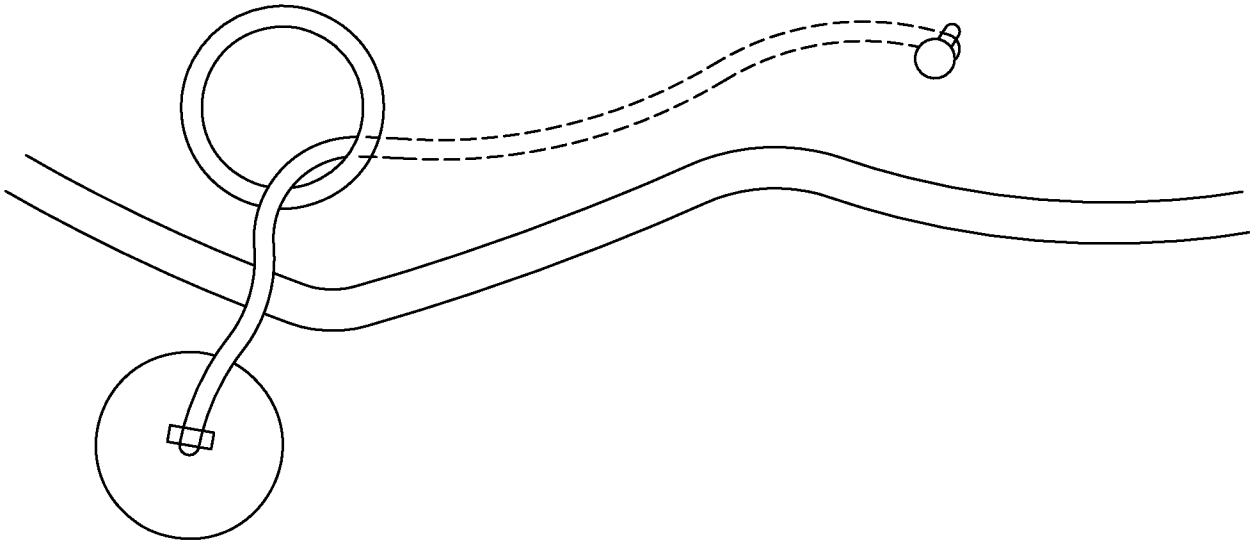
FIG. 2 is an enlarged detail of the helmet of FIG. 1, including a tether used to secure the cap.
Figure 3:
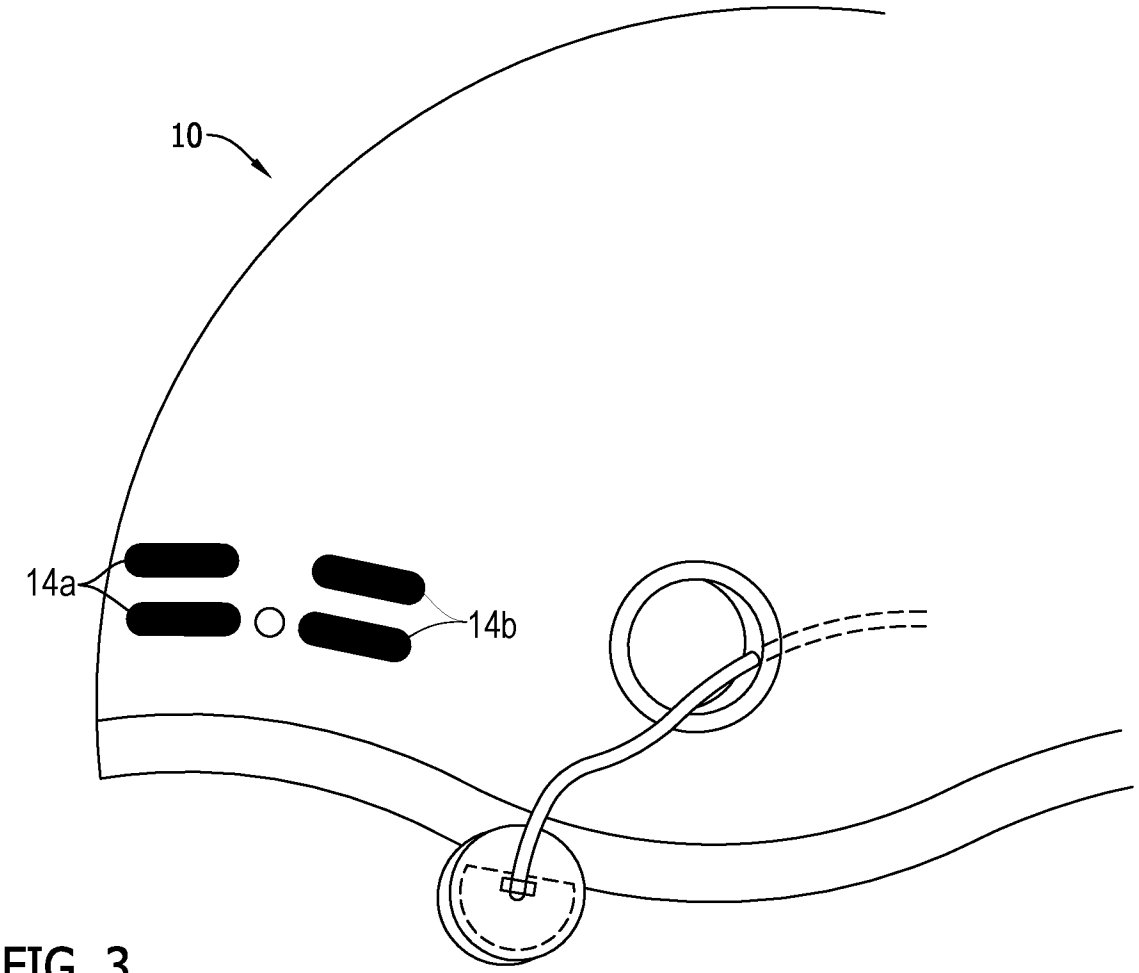
FIG. 3 illustrates another view of the opening of FIG. 2, with the cap detached from the opening of the protective shell.

As shown in FIG. 1B, in some embodiments, the opening 2 is sized to receive locking mechanism, such as a U-lock 34, a cable or a chain through the opening 2, for locking the helmet 10 and bicycle to a fixed object, such as a bike rack or a post 36 embedded in pavement 38. In some embodiments, the opening is designed to accommodate a variety of bike locks. The diameter of the opening should be large enough to accommodate a U-lock 34 or a chain, but small enough so as not to compromise the integrity and protective function of the helmet 10. Additionally, the circular shape allows the opening to accommodate the lock 34 while the lock and helmet are in a broad variety of positions. In some embodiments, the opening 2 has a dimension between 1 inch (2.54 cm) and 1.5 inch 3.8 cm). For example, the opening can be a circular opening with a diameter of about 1.312 inch, (e.g., from 1.25 inch to 1.375 inch). In other embodiments, the shape of the opening 2 is a quadrilateral (e.g., a rectangle or trapezoid), pentagon, hexagon, octagon, or other polygon.

In some embodiments, the opening 2 is positioned so that when the helmet 10 is worn, the opening 2 is above and behind the user's (left or right) ear, anterior to the rear of the skull, and below the impact test line specified by 16 CFR § 1203.11. This location of opening 2 ensures that the helmet 10 performs well in impact safety testing. Because the opening 2 is located toward the rear of the helmet and near the lowest end of the helmet, the opening 2 can be made larger to accommodate a broad variety of locks, chains and cables with acceptable safety.

Figure 9A:
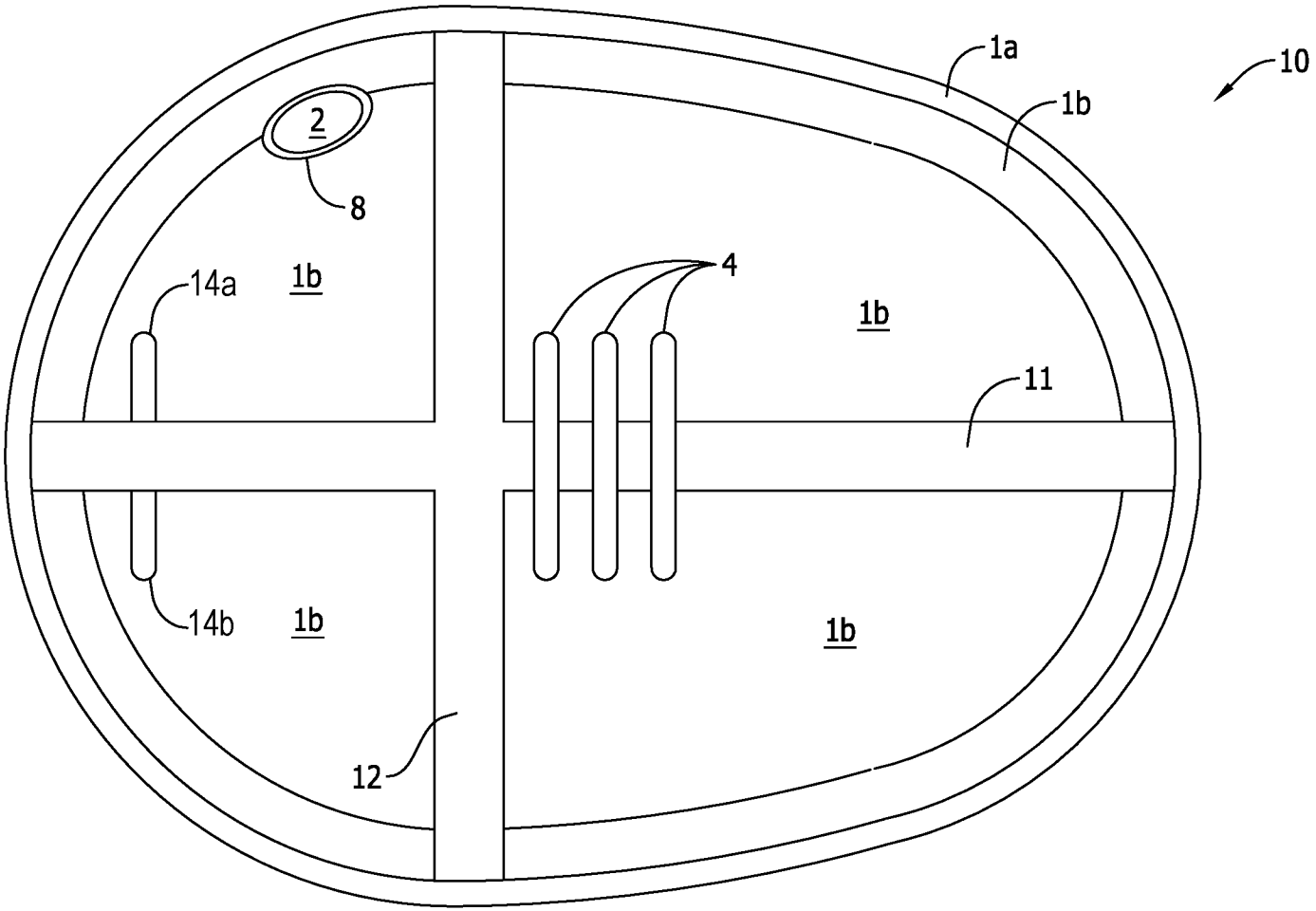
FIG. 9A is a bottom view of the helmet of FIG. 1, taken along section line 9-9 of FIG. 1.

FIG. 9A is a bottom (inside) view of the helmet of FIG. 1, taken along section line 9-9. In some embodiments, the protective shell 1 includes an exterior shell 1*a* and an interior shell 1*b*. The exterior shell 1*a* is a hard plastic, such as polycarbonate, polystyrene, or fiberglass that primarily protects the skin of the head from cuts, contusions and abrasions, and disperses energy before reaching the interior shell. The exterior shell 1*a* also absorbs some energy when the helmet sustains an impact. The harder exterior shell 1*a* also protects the interior shell 1*b* from normal wear and tear during storage, handling and use.

In other embodiments, the exterior shell 1*a* can comprise another impact absorbing polymer material (impact or shock resistant material). The material can be thermoplastic, a thermoset, a blend or a composite, e.g., a thermoplastic material such as polycarbonate, ABS (acrylonitrile butadiene styrene), high density polyethylene (HDPE), polypropylene; a polymer layer filled with air or a polymer honeycombed structure; a reinforced thermoset resin e.g., vinylester, polyester, epoxy, or urethane. The material can be reinforced with reinforcing fiber or filler, e.g., glass fiber, aramid fiber, Kevlar, carbon fiber.

In some embodiments, the opening 2 includes a ledge 2L (shown in FIGS. 4A and 4B) formed in the exterior shell 1*a*. The ledge 2L has a depth DL from the outside surface of the exterior shell 1*a*. The cap 3 has a thickness TC substantially equal to the depth DL of the ledge 2L, so that when the cap 3 is seated on the ledge 2L in the opening 2, the top surface of the cap 3 is coplanar (flush) with the outside surface of the exterior shell 1*a*. To facilitate gripping the cap 3 to remove the cap 3, some embodiments include a raised edge 9, beneath which h a small cavity 9*c* is formed.

Figure 4B:
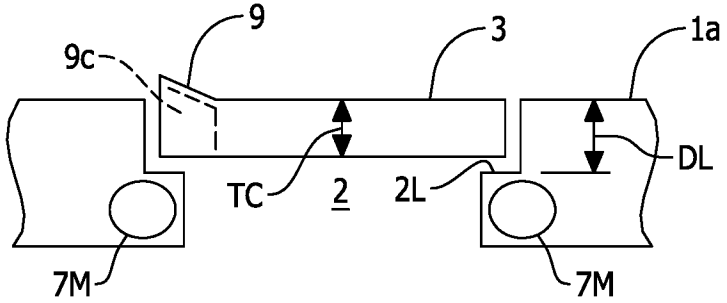
FIG. 4B is a cross-sectional view of the opening and cap of FIG. 4A.
Figure 4C:
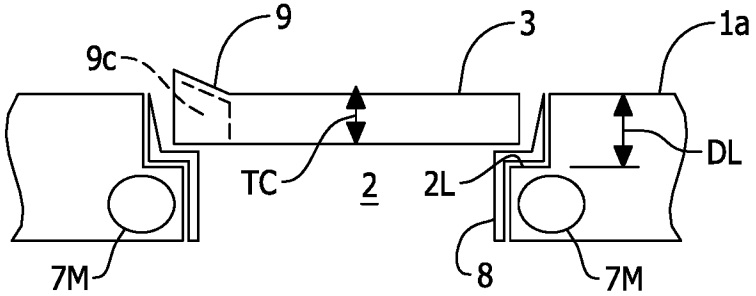
FIG. 4C is a view of the opening and cap of FIG. 4A, with a cover ring protecting the edge of the exterior shell around the opening.

FIG. 4C is a cross section of an opening 2 and ledge 2L as shown in FIG. 4B, with the addition of a cover ring 8. In some embodiments, a protective circular cover ring 8 surrounds the opening 2 of the interior shell 1*b*. In some embodiments, the cover ring 8 can serve one or more purposes. In some embodiments, the cover ring 8 serves as a reinforcement to protect the plastic around the opening 2 during normal handling and during impact. For reinforcement, in some embodiments the cover ring 8 covers the cylindrical side wall of the opening 2. In other embodiments, the cover ring 8 can cover an annular ring around the opening 2 on the outside surface of exterior shell 1*a*, an annular ring around the opening 2 on the inside surface of interior shell 1*b*, and the cylindrical side wall of the opening 2 between the outside surface and inside surface. This circular ring 8 protects the softer internal material of the interior shell 1*b* from abrasion when a locking mechanism is looped through it.

In some embodiments, the cover ring 8 also includes a means for attaching the cap 3 to the helmet 10 (e.g., a female thread (not shown) in the cover ring 8 around the opening 2 for receiving a cap having a male thread). In other embodiments, the means for attaching the cap is a part of the exterior shell 1*a*. In various embodiments, the exterior shell 1*a* includes a means for attaching the cap 3, which can include a magnet, a female thread, a pin, a hinge, hook and loop (e.g., "VELCRO") fastener, a suction mechanism, or the like.

Figure 4A:
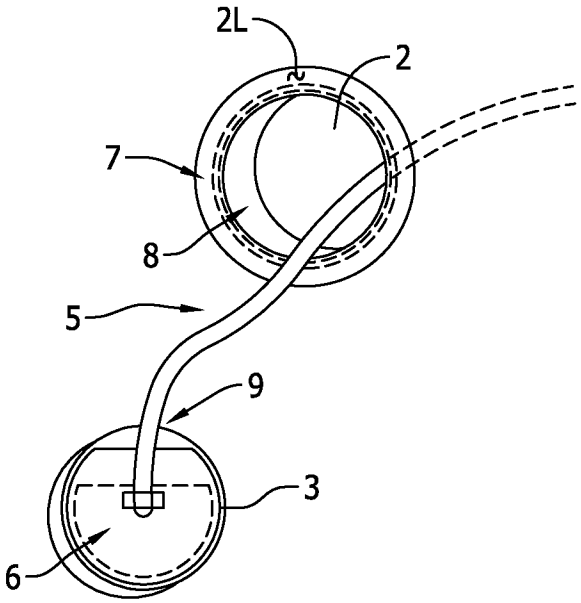
FIG. 4A illustrates a detailed view of the cap and opening of FIG. 2.
Figure 4D:
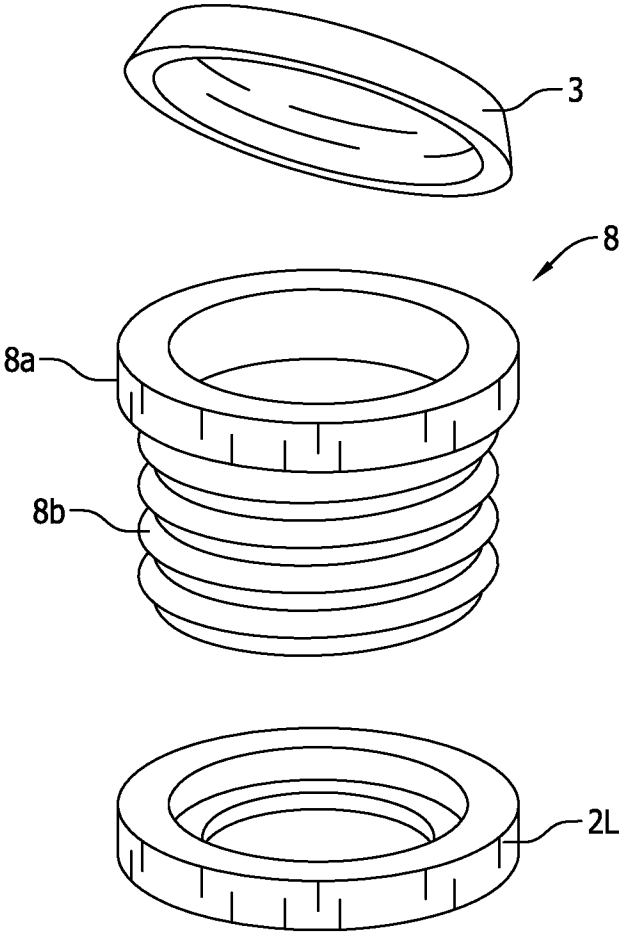
FIG. 4D is an exploded view showing an embodiment of the ledge, cover ring and cap.
Figure 5:
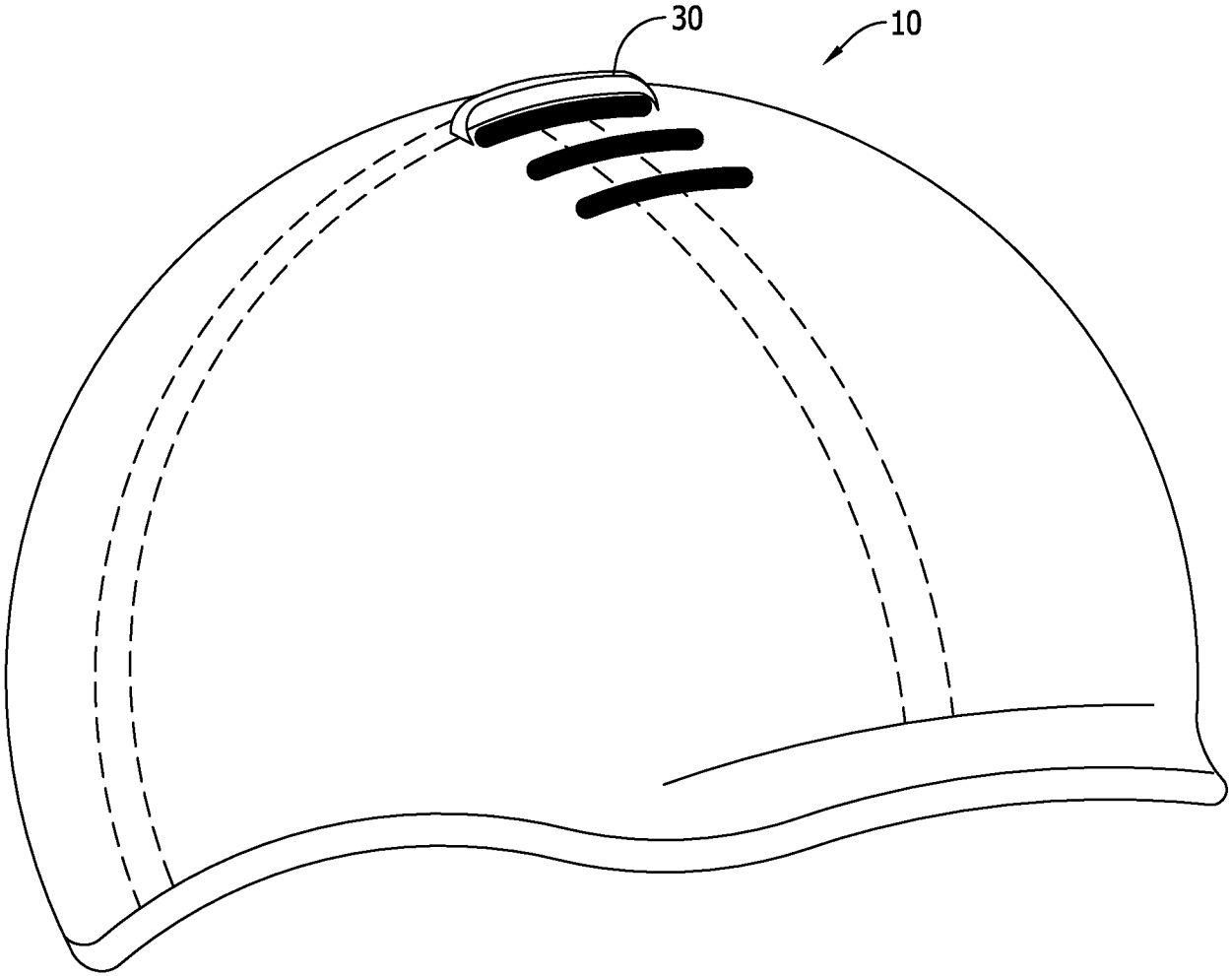
FIG. 5 is an isometric view of an exemplary embodiment of the helmet of FIG. 1, further including air vents, an air channel, and an air scoop.

FIG. 4D is an exploded view of the ledge 2L, cover ring 8, and cap 3. In FIG. 4D, the exterior protective shell 1*a* is omitted for ease of viewing, except for the ledge 2L. The cover ring 8 includes a horizontal portion 8*a* that is seated over the ledge 2L of the exterior shell 1*a*. A lower section 8*b* is adapted to be mounted in the opening 2. A variety of methods can be used to attach the cover ring 8 to the exterior shell. For example, in some embodiments, the lower section 8*b* can have a male thread that engages a female thread of a nut (not shown) inside the helmet 10, or a female thread in the exterior shell 1*a* itself. In other embodiments, the lower section 8*b* has an interference fit with the opening of the exterior shell 1*a*. In other embodiments, the cover ring 8 is joined to the exterior shell 1*a* by adhesive or fusion bonding.

The interior shell 1*b* comprises a softer material, such as a molded plastic foam, which can include but is not limited to: expanded polystyrene rigid polyurethane, or polyolefin. The interior shell 1*b* absorbs energy when the helmet 10 sustains impact and provides thermal insulation. In some embodiments, the interior shell 1*b* also includes one or more internal air channels 11 and 12 that help circulate airflow when air enters the helmet through a ventilation hole 4. FIG. 9A shows a posterior-anterior air channel 11 and a transverse air channel 12. In some embodiments, one or more posterior-anterior air channels 11 are provided, without any transverse air channel. In other embodiments, three or more posterior-anterior air channels 11 are provided.

In other embodiments, the interior shell 1*b* can comprise a relatively soft/flexible/elastic energy-absorbing material. The material can be thermoplastic or a thermoset, a foamed or expanded polymer or polymer blend, e.g., polyurethane foam, expanded polyolefins such as expanded polystyrene (EPS) and expanded polypropylene (EPP), flexible polyurethane, plasticized polyvinylchloride, medium density polyethylene, ethylene vinyl acetate, or the like. In some embodiments, the pieces of interior shell can also be filled with a second foam material.

The helmet 10 includes an opening 2 through which a user can pass a locking mechanism, so that the helmet 10 may be securely locked to the bicycle or another stationary object. When the locking mechanism is engaged, the helmet 10 cannot be removed from the locking mechanism until the locking mechanism is disengaged. In some embodiments, the helmet 10 allows a locking mechanism to be looped through the opening so that the helmet 10 is securely attached to a bicycle, a fixed object (e.g., a post), or both. This physical engagement allows a user to quickly and safely secure the helmet 10 when it is not being worn.

In some embodiments, the helmet 10 includes a cap 3 used to cover the opening 2, and a tether 5 for securing the cap 3 to the helmet 10. The cap 3 can be used to cover the opening 2 when the locking mechanism is not attached to the helmet through the opening 2. The cap 3 may also be used to partially cover the opening 2 when the locking mechanism is attached to the helmet 10 through the opening. The cap can be formed of a plastic, such as polycarbonate, polystyrene, or polyethylene.

The cap 3 may conceal the opening 2. As shown in FIG. 4A, the cap 3 may also have a means for retaining the cap 3 near the opening 2 when the cap is not attached to the opening. For example the retaining means can include a tether 5 attached to the protective shell 1 and to the cap 3, which allows the cap 3 to be detached from the protective shell 1 by a short distance, but prevents the user from dropping or losing the cap 3. The tether 5 can be formed of a thin rope, a nylon cord, or the like. The tether 5 can be secured to the inside of the exterior shell by a fastener, such as a rivet or the like. The cap 3 can be detachably attached to the opening 2, so that attachment and detachment can both be performed reversibly and repeatedly by hand without using any tools.

In some embodiments, the means for attaching the cap 3 to the helmet 10 includes means for attaching the cap to a ledge 2L (FIGS. 4B, 4C) in the exterior shell 1*a*. The means for attaching can include at least one magnet 7, and either a piece of ferrous material or a second magnet 6. In some embodiments, at least one magnet 7 is embedded in the cap 2, and a piece of ferrous metal or second magnet is provided around the opening 2, within a space between the ledge 2L and the cover ring 8, or embedded in the cover ring 8. In other embodiments, the cap 2 has a piece of ferrous material therein, and the helmet has magnet around the ledge 2L, within a space between the ledge 2L and the cover ring 8, or in the cover ring 8. Using the magnet 6 and magnet or ferrous piece 7, the cap 3 stays firmly affixed and flush against the helmet 10. In some embodiments, which have a ledge 2L in the opening 2, as shown in FIGS. 4B and 4C, a magnet or piece of ferrous material 7M can be embedded under the ledge 2L. The magnet 7 or 7M allows the user to easily return the cap 3 to seat in the opening 2 by merely placing the cap 3 close enough to the opening 2 to allow the magnetic force to pull the cap 3 into its seat on ledge 2L, with the top surface of the cap 3 flush or substantially flush with the outside surface of exterior shell 1*a*.

In some embodiments, the cap 3 has a slightly raised lip or hump 9 at its perimeter, and the raised lip has a bottom surface that is flush or above the outside surface of the exterior shell 1*a*, adjacent the cap 3. A user can insert a fingernail or thin object under the lip 9 to lift the cap 3. This raised surface 9 allows users to easily to find and remove the cap.

Figure 10:
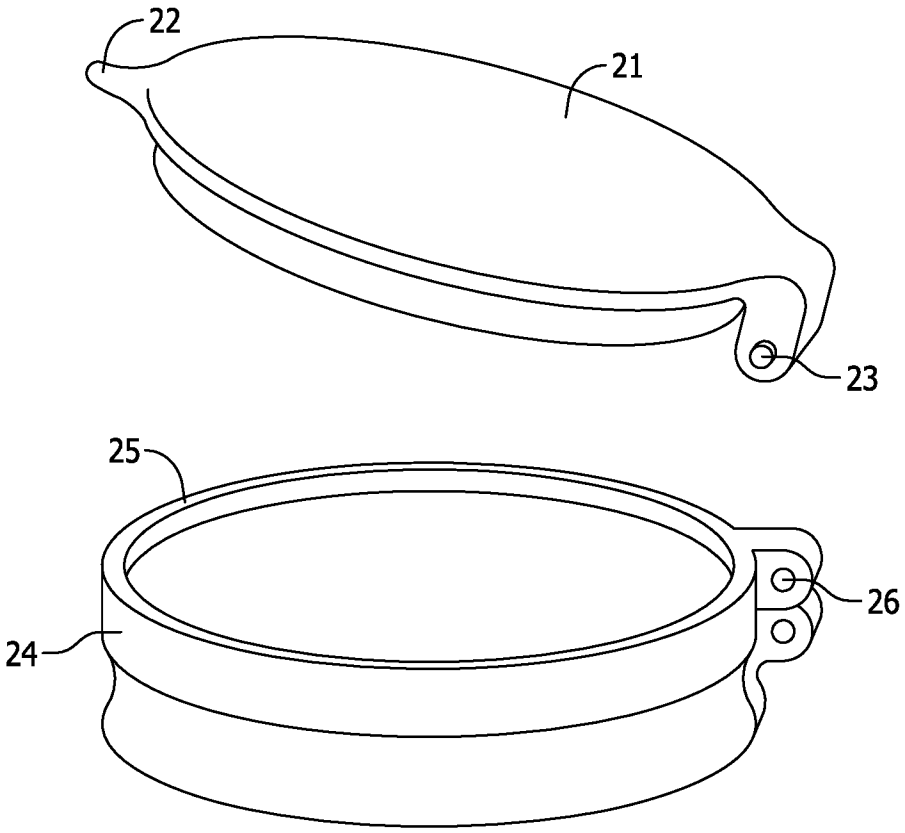
FIG. 10 is an isometric view of an embodiment having a hinge-type means for attaching the cap to the helmet.

FIG. 10 shows another embodiment of a helmet lock port cover including a substantially flat lid 21 that covers the helmet opening, ensuring more symmetrical airflow and improving appearance. In addition, the attaching overhanging lip 22 provides a visual queue to the user that the cover 21 is intended to be opened and used as a lock port. Also, the circular ring 24 and its slight overhang 25 act as a protective trim and can extend the life of the lock port.

The flat circular lid 21 covers the lock port opening or opening 2. In some embodiments, the lid 21 is about 3 cm in diameter (e.g., from 2.8 to 3.2 cm) and remains attached to a circular ring 24 through the interlocking nipples or pins 23; in addition, the lid 21 has a slight overhanging lip 22 that facilitates opening and closing the lid 21. The circular ring 24 and its slight overhang 25 protect the helmet's interior shell 1*b* and exterior shell 1*a* from wear and tear and from the impact of the lock's blunt edge; the circular ring 24 has a depth sufficient to cover the combined depth of the helmet's interior shell 1*b* and exterior shell 1*a*. This design allows the lock port cover 21 to appear flush with the helmet's outside surface.

In FIG. 10, the nipples or pins 23 are received by complementary openings 26 in the lid 21 and the circular ring 24, forming a hinge-type means for retaining the cap 21. The nipples or pins 23 provide a pivoting capability, and prevent the user from dropping or losing the lid 21 when the lid 21 is opened. Thus, the embodiment of FIG. 10 provide an integrated means for attaching the cap to the opening and means for retaining the cap near the opening when the cap is not attached to the opening.

Figure 11:
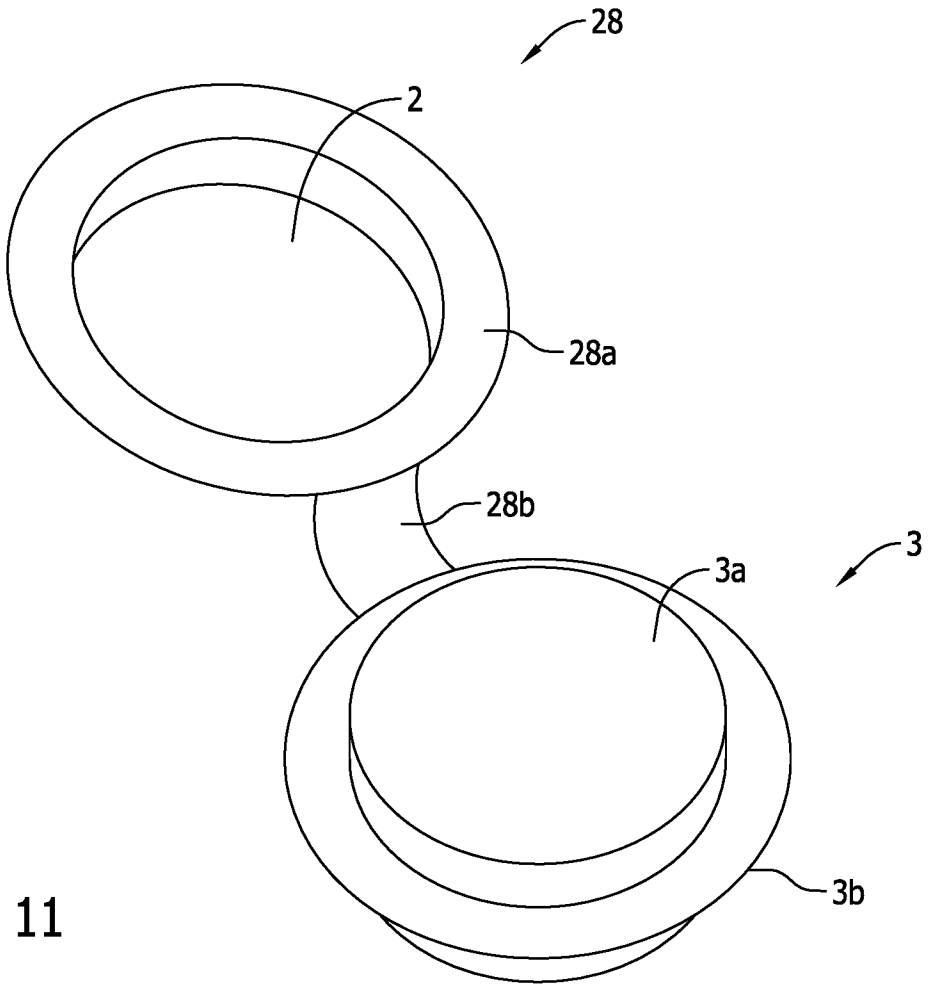
FIG. 11 shows an embodiment of a unitary cap and cover ring unit according to some embodiments of the helmet.

FIG. 11 shows an embodiment of a unitary cap and cover ring unit 28 according to some embodiments of the helmet. The cap and cover unit 28 includes a cover ring portion 28*a*, which provides the function of the cover ring 8 discussed above. The cover ring portion 28*a* can be mounted to the exterior shell 1*a* using any of the methods discussed above with respect to cover ring 8. The cap portion 3 snaps onto the cover ring 28*a*. For this purpose, the unitary cap and cover ring unit 28 can comprise softer materials such as rubber or low density polyethylene. The cap portion 3 may include a male portion 3*a* that fits into the inner circumference of the cover ring portion 28*a*, and a top 3*b* which acts as a stop for the cap 3. The cap and cover ring unit 28 includes an integral tether portion 28*b* which serves as a means for retaining the cap 3.

FIGS. 5 to 8 show an embodiment of the helmet 10 having at least one air scoop 30 for driving ambient air into at least one of the channels 11 and/or 12 of the helmet 10. The helmet 10 may also include air vents 4 for directing air flow through the exterior shell 1*a* into the helmet, and one or more channels 11, 12 in the interior shell 1*b*, for directing the air flow inside the helmet. In some embodiments, the air vents 4 are located on top of the helmet. In other embodiments (not shown), the air vents 4 can be located anywhere between the front of the helmet and the top of the helmet.

Figure 8:
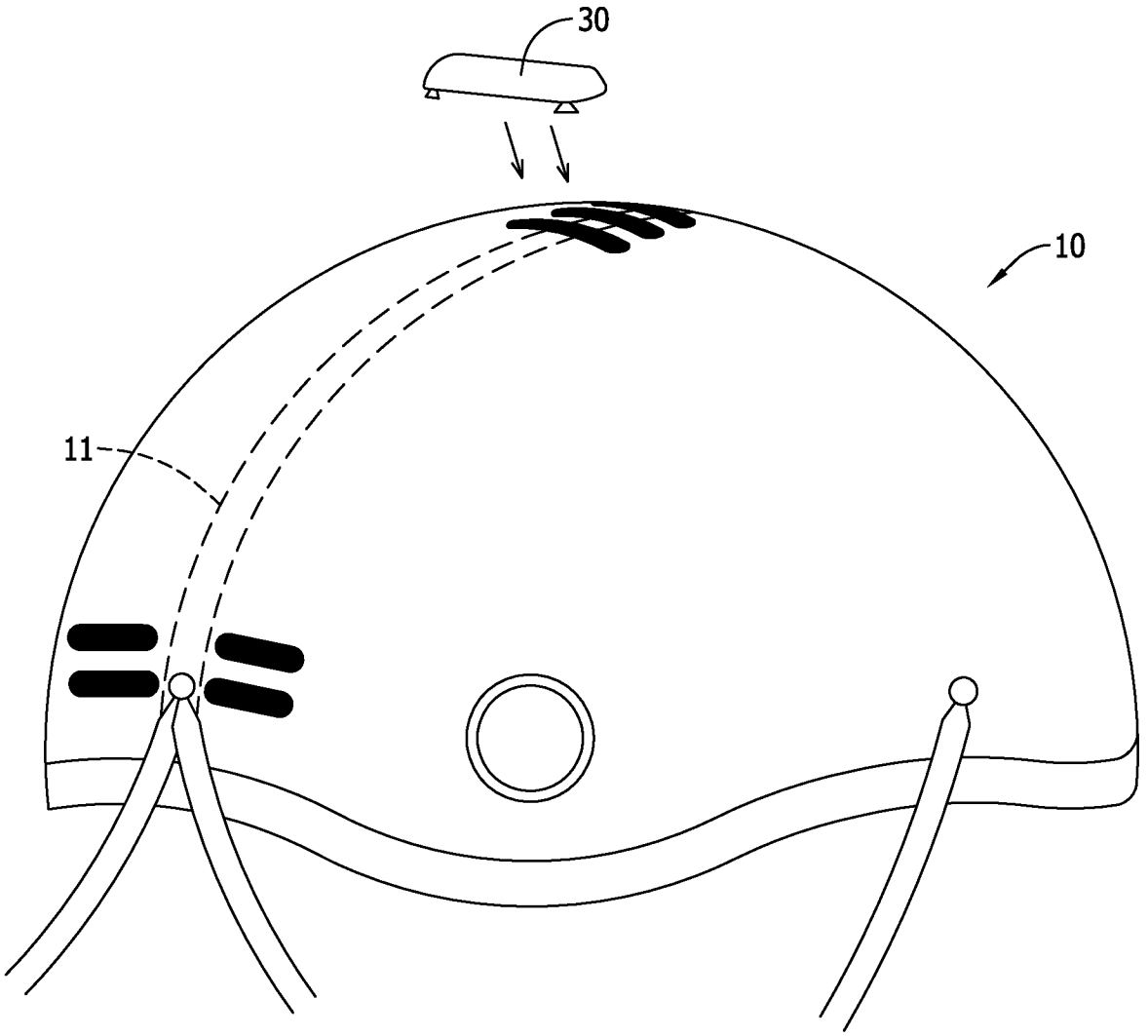
FIG. 8 is an exploded view of the helmet of FIG. 5, including air vents and an air scoop.

In some embodiments, the channel 11 extends at least from the vent 4 (to which the air scoop 30 is attached) to the rear of the helmet 10. In some embodiments one or more of the channels 11 intersect with at least one rear vent 14 at the rear of the helmet 10. The rear end 11*r* of the channel 11 and/or rear air vent 14 allows heated air to escape from the helmet, and cool the wearer's head. The air scoop 30 has a front opening 32 which is exposed to the air velocity pressure. (As the bicycle moves with a forward velocity, the velocity pressure of air entering the scoop is proportional to the square of the forward velocity.) The combination of the higher air pressure at the vent 4 beneath the air scoop 30 and the lower pressure behind the rear vent 14 draws the air through channel 11. The location of the air vents 4, rear air vents 14 and channels 11, 12 are based on where a user's head is most likely to become overheated. In some embodiments, the air vents 14 are located below the impact test line specified by 16 CFR § 1203.11. In some embodiments, as shown in FIG. 8, four rear air vents 14 are located on the lower back of the helmet 10 and 3 air vents 4 are located on the top of the helmet 10. Other configurations may be used to regulate the amount of air flow.

Figure 6A:
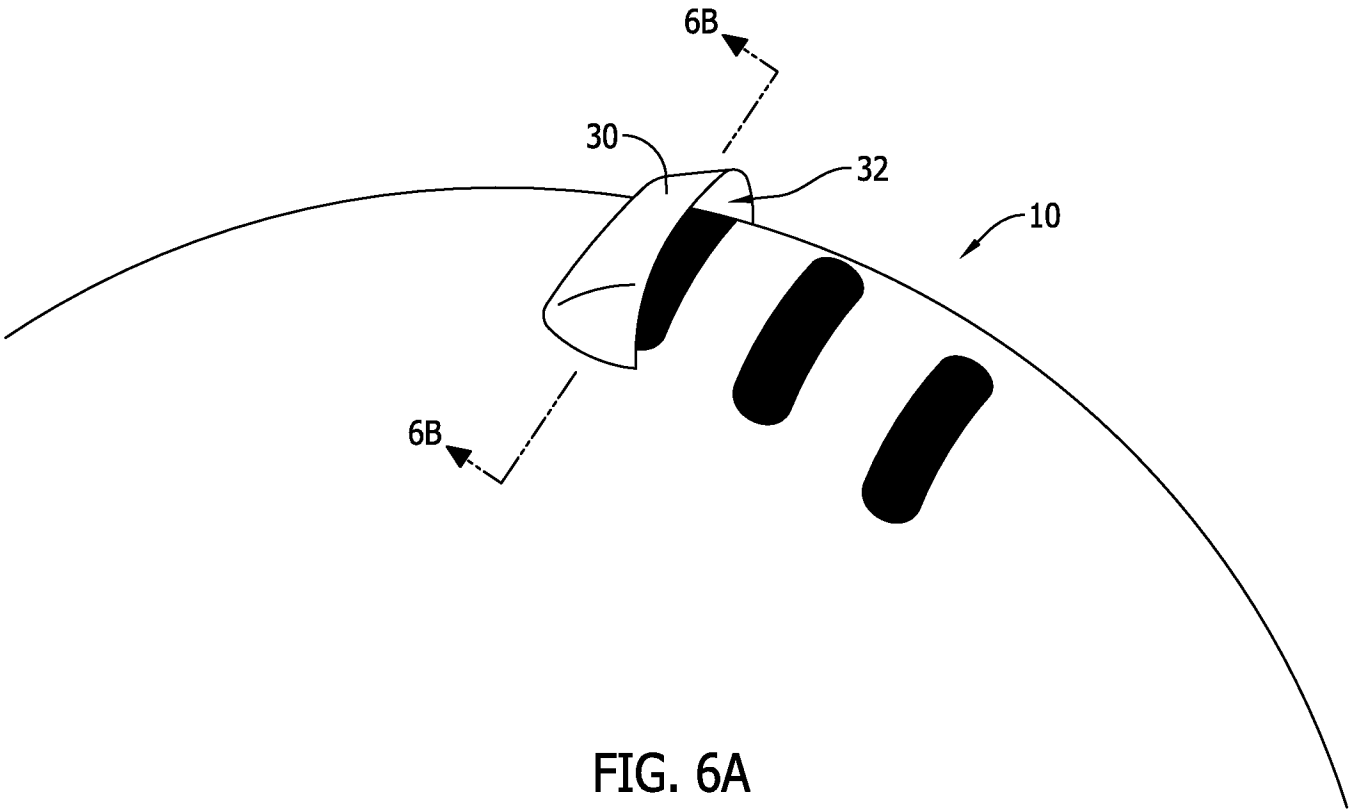
FIG. 6A illustrates a view of a detail of the helmet including the air vents and an air scoop.
Figure 6B:
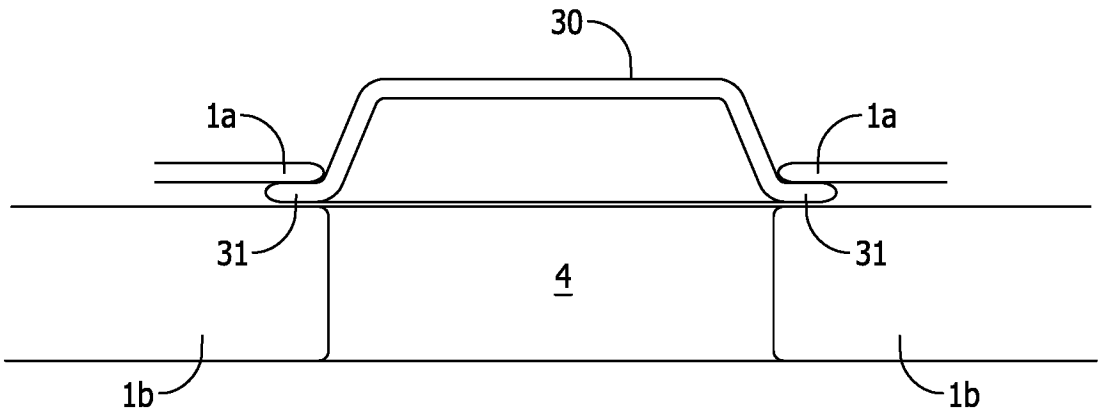
FIG. 6B is a cross-sectional view taken along section line 6B-6B of FIG. 6A.
Figure 7:
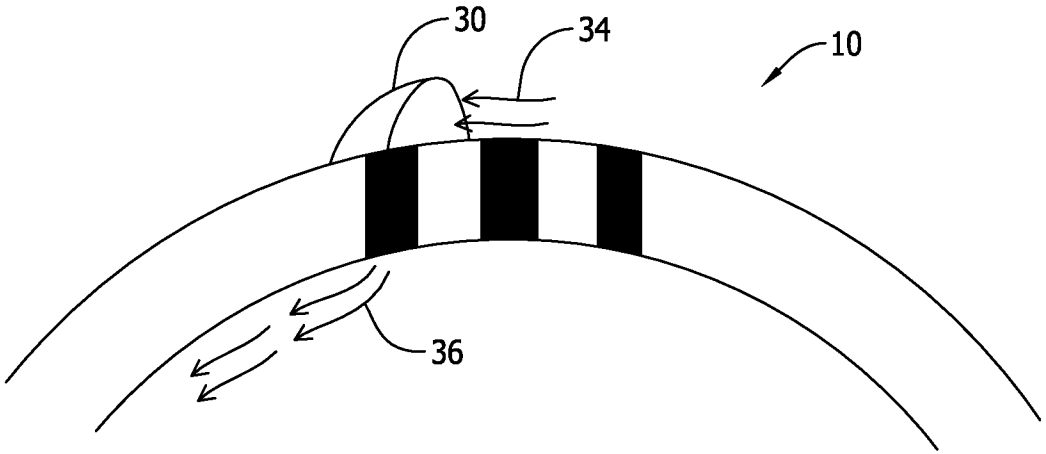
FIG. 7 illustrates a schematic view of the helmet of FIG. 5, showing the direction of the air flow through the scoop and air vent.

In some embodiments, the detachable air scoops 30 are designed to lock into the helmet's top vents 4. These detachable scoops 30 actively catch and guide air into the top vents 4. The air scoop 30 is detachable, so that attachment and detachment can both be performed reversibly and repeatedly by hand without using any tools. For example, as shown in FIG. 6B, the scoop 30 has a plurality of tabs 31 extending outwardly. The material of the scoop 30 can be deformed elastically by squeezing the ends of the scoop together, to permit insertion of the tabs 31 into the space between the exterior shell 1*a* and the interior shell 1*b*. The vents 4 are also designed to align with the interior shell's internal air channels 11, 12. These internal air channels 11, 12 further help circulate airflow throughout the entire helmet 10. The flow path from air scoop 30 is connected to the rear of the helmet, to restore airflow to the back of the user's head, most of which would otherwise be blocked by the wearing of a helmet. Although FIG. 9A only shows one anterior-posterior air channel 11 and one transverse air channel 12, other embodiments can have multiple air channels in either or both directions.

The detachable air scoops 30 allow the user to control and modulate the amount of air flow and cooling. For example, given a helmet 10 having three air vents 4, the user can attach 0, 1, 2 or 3 air scoops to adjust the amount of air cooling. In some embodiments, the air scoop 30 snaps on an off of the helmet, to allow quick attachment and detachment. In other embodiments, the air scoop 30 can be permanently attached to the helmet.

To attach the air scoops 30, some embodiments include two L-shaped wedges that protrude from the body of air scoop and slide and lock in between the exterior shell 1*a* and interior shell 1*b* at the location of the top air vents 4. The wedges are rounded to match and interlock with the edges of the top air vents 4. In addition, the wedges are positioned over the corner edges of air vents 4 to increase the stability of the air scoops 30 when the bicycle or vehicle moves with forward velocity, thereby increasing the air pressure. Other embodiments may include threading the air scoops 30 through the interior shell 1*b* and exterior shell 1*a*, only through the exterior shell 1*a*, or only to the internal shell 1*b*. The wedges may formed of the same piece of material as the exterior shell 1*a*, or the wedges may be completely detachable.

The air scoop 30 can comprise a thermoplastic material, a thermoset, a blend or a composite, e.g., a thermoplastic material such as polycarbonate, ABS HDPE, polypropylene; a polymer layer filled with air or a polymer honeycombed structure; a reinforced thermoset resin e.g., vinylester, polyester, epoxy, or urethane. The material can be reinforced with reinforcing fiber or filler, e.g., glass fiber, aramid fiber, Kevlar, or carbon fiber.

Figure 9B:
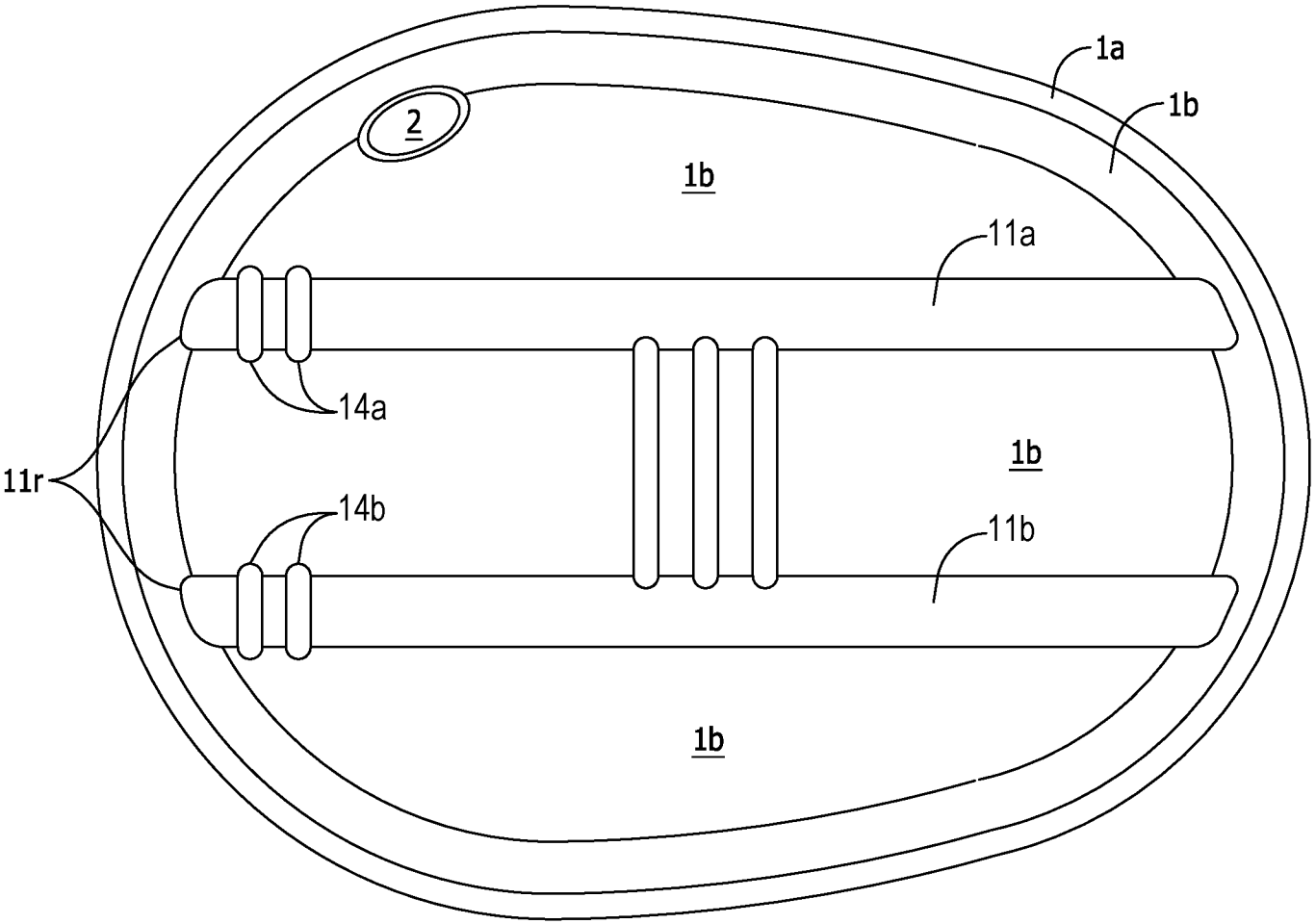
FIG. 9B is a bottom view of a variation of the helmet shown in FIG. 9A, including two anterior-posterior air channels.

For example, as shown in FIG. 9B, in some embodiments, there are two anterior-posterior air channels 11*a* and 11*b*, each connecting to respective rear air vents 14*a* and 14*b*. Each of the two air channels 11*a* and 11*b* is connected to a respective end of each of the air vents 4, on opposite ends of the vents 4. Each channel 11*a* and 11*b* is aligned with respective rear air vents 14*a* and 14*b*, to maximize flow to the rear air vents 14*a* and 14*b*.

As shown in FIG. 9B, the air channels 11*a* and 11*b* can extend part way into the material of the interior shell 1*b*. Beneath the channels 11*a* and 11*b*, the material of the interior shell 1*b* is thinner than elsewhere, but still sufficiently thick to provide protection and to ensure the integrity of the whole interior shell 1*b*. For example, in some embodiments, the thickness of the interior shell 1*b* at the front of the helmet is about 0.563 inch (1.43 cm) in the channel 11, and about 0.75 inch (1.91 cm) elsewhere. In some embodiments, the thickness of the interior shell 1*b* is less at the back of the helmet than at the front. For example, in some embodiments, at the back of the helmet, the thickness of the interior shell 1*b* is about 0.25 inch (0.635 cm) in the channel 11 and 0.437 inch (1.07 cm) elsewhere. In some embodiments, the only openings which completely penetrate the interior shell 1*b* are the air vents 4, the rear air vents 14 and the opening 2.

Figure 9C:
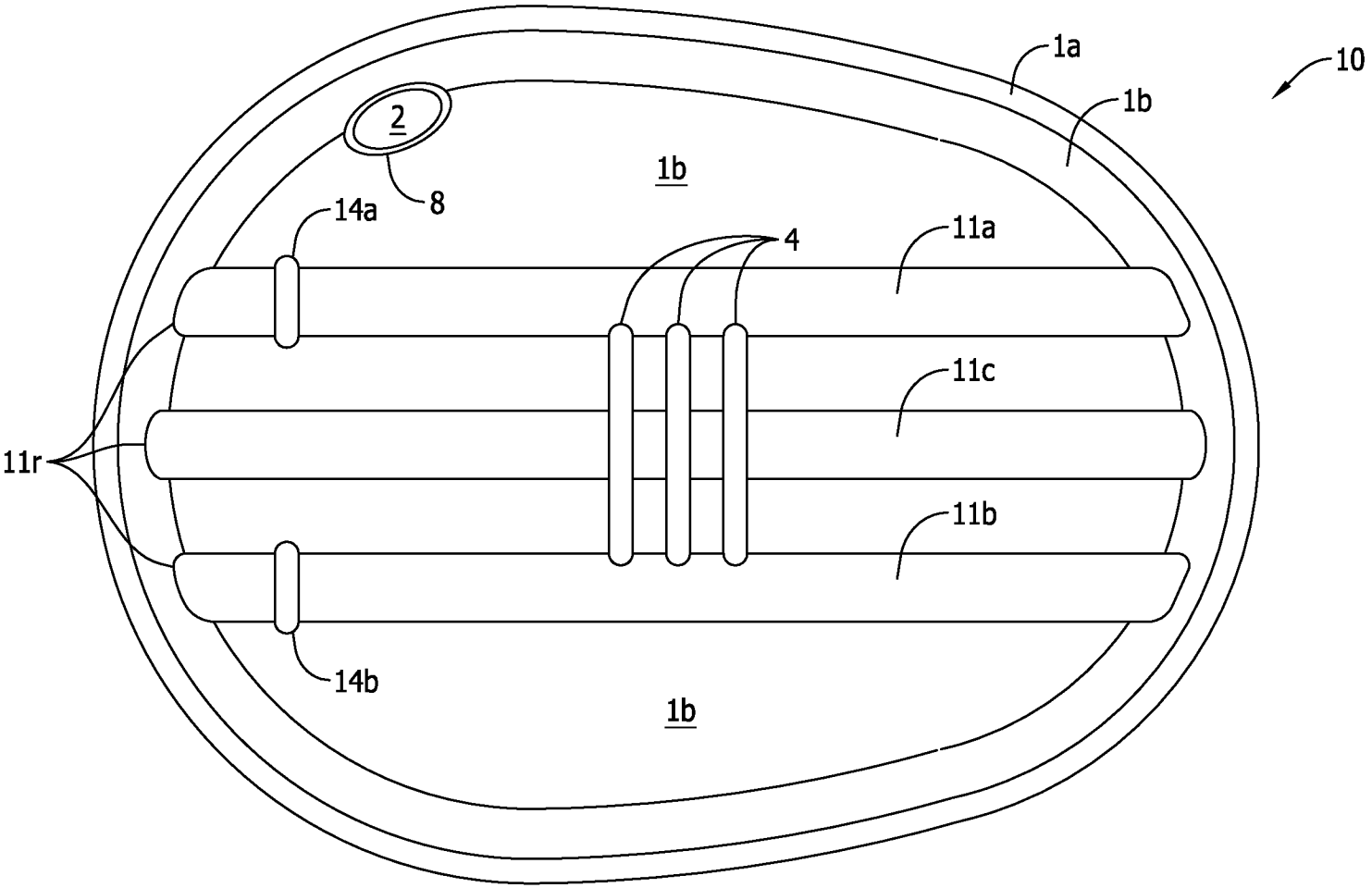
FIG. 9C is a bottom view of a variation of the helmet shown in FIG. 9A, including three anterior-posterior air channels.

In other embodiments, as shown in FIG. 9C, there are three anterior-posterior air channels 11*a*-11*c*, each having a rear end 11*r* at the rear end of the helmet 10. The helmet 10 has a first vent 4 at a top of the helmet 10, and at least a second (e.g., top) rear vent 14*a* and a third (e.g., bottom) vent 14*b* at a rear of the helmet. The first air channel 11*a* connects the first vent 4 to the second vent 14*a*, and the second air channel 11*b* connects the first vent 4 to the third vent 14*b*. The third air channel 11*c* connects the first vent 4 to the second vent 14*a* and the third vent 14*b*. As shown in FIG. 9C, a vent 4 can either extend across the entire width of a channel (e.g., 11*c*) or have one end connected to the channel (e.g., 11*a*, 11*b*). A channel can intersect with a rear vent 14 along the entire width of the channel (e.g., 11*a*, 11*b* intersect rear vents 14*a*, 14*b* along the entire widths of channels 11*a*, 11*b*, respectively), or the channel can be connected to the end of at least one vent (e.g., channel 11*c* is connected to respective ends of vents 14*a* and 14*b*).

As discussed above with respect to FIG. 9B, the air channels 11*a*-11*c* can extend part way into the material of the interior shell 1*b*. Beneath the channels 11, the material of the interior shell 1*b* is thinner than elsewhere, but still sufficiently thick to provide protection and to ensure the integrity of the whole interior shell 1*b*.

In the examples shown in FIGS. 1A to 9C, the exterior shell 1*a* of the helmet 10 is continuously solid, except for the opening 2, the vents 4 and the rear vents 14. Of these openings, both the opening 2 and rear vents 14 are located below the impact test line, enhancing impact protection. The inclusion of the air scoop 30 coupled to the anterior-posterior channels 11 provides cooling without adding additional openings in the protective shell 1, which could reduce protection against contusions and abrasions.

The helmet having the cap 3 shown in FIGS. 1A-4D can be configured with or without the air scoop 30 as shown in FIGS. 5-8. The helmet (with or without the air scoop 30) can be configured with any of the combination of air channels shown in any of FIGS. 9A to 9C. Any of the embodiments described in this paragraph can include the cap 3 of FIG. 4A, the pivoting cap 21 of FIG. 10, or the unitary cover ring and cap unit 28 shown in FIG. 11.

A helmet lock port cover such as cap 3 provides several advantages. The cap 3 protects the user from wind, insects or infiltration of other debris while cycling. The cap 3 can protect the edges and side walls of the opening against repeated wear during use and handling. The cap 3 hides these opening 2 and maintains the symmetry of the aerodynamic characteristics of the helmet while riding. The cap 3 also helps define the opening's purpose as a lock port, and provides a visual reminder to the user to lock the helmet to the bicycle and/or stationary object.

Although the subject matter has been described in terms of exemplary embodiments, it is not limited thereto. Rather, the appended claims should be construed broadly, to include other variants and embodiments, which may be made by those skilled in the art.

The invention claimed is:

1. A helmet comprising:

a protective shell shaped to protect a head of a user, the protective shell having an exterior surface, an interior surface, at least two rear vents at a rear end of the protective shell, the rear end comprising no more than a rear quarter of the protective shell, the at least two rear vents each extending from the exterior surface to the interior surface, and at least one opening extending from the exterior surface to the interior surface, wherein the protective shell comprises an exterior shell and an interior shell, the protective shell has at least a first top vent extending from the exterior surface to the interior surface, the at least two rear vents include a first rear vent and a second rear vent, and the interior shell has at least a first air channel extending from the first top vent past at least one of the first rear vent and the second rear vent, wherein the at least one of the first rear vent and the second rear vent extends across at least a portion of the width of the first air channel, at least one detachable cap sized and shaped to fit into the at least one opening, and a tether for retaining the at least one detachable cap such that the at least one detachable cap is operatively coupled to the helmet when detached, wherein the tether extends through the at least one opening when the at least one detachable cap is detached, and wherein the tether is attached to the at least one detachable cap and to the protective shell.

2. The helmet of claim 1, wherein the helmet includes at least one air scoop operatively coupled to the first air channel at the first top vent such that the at least one air scoop is in fluid communication with at least one of the first rear vent and the second rear vent or the rear end of the helmet.

3. The helmet of claim 2, wherein the at least one air scoop is detachable from the helmet.

4. The helmet of claim 1, wherein:

the first top vent is located at a top of the helmet, the interior shell has a second air channel extending from the first top vent past at least one of the first rear vent and the second rear vent, and the first air channel connects the first top vent to the first rear vent, and the second air channel connects the first top vent to the second rear vent.

5. The helmet of claim 4, wherein:

the interior shell has a third air channel, and the third air channel connects the first top vent to the rear end of the protective shell.

6. The helmet of claim 1, wherein the at least one opening is sized and shaped to receive a U-lock therethrough.

7. The helmet of claim 1, wherein the at least one opening is circular, further comprising a circular ring covering a sidewall of the at least one opening.

8. The helmet of claim 1, wherein one of the at least one detachable cap or the helmet has a first magnet, and the other of the at least one detachable cap or helmet has a ferrous member or a second magnet, positioned so that the first magnet and the ferrous member or second magnet holds the at least one detachable cap in the at least one opening.

9. The helmet of claim 1, further comprising means for attaching the at least one detachable cap to the at least one opening.

10. The helmet of claim 1, wherein the at least one detachable cap has a lip protruding from an exterior surface of the at least one detachable cap, and a cavity beneath the lip.

11. The helmet of claim 1, further comprising a ledge formed in the exterior shell in the at least one opening.

12. The helmet of claim 11, wherein the at least one detachable cap has a raised edge on an exterior surface of the at least one detachable cap.

13. The helmet of claim 1, wherein the at least one of the first rear vent and the second rear vent extends across the entire width of the first air channel.

14. A helmet comprising:

a protective shell shaped to protect a head of a user, the protective shell having an exterior surface, an interior surface, at least one opening extending from the exterior surface to the interior surface, and a plurality of vents, each of which extending from the exterior surface to the interior surface, wherein the at least one opening is sized and shaped to receive a U-lock therethrough, and wherein the at least one opening is entirely positioned on a lower half of the protective shell and on a rear third of the protective shell, said lower half being between a lower rim of the protective shell and a top of the protective shell, and said rear third being closer to a rear end than a front half of the protective shell, at least one detachable cap sized and shaped to fit into the at least one opening, wherein the at least one detachable cap has a lip protruding from an exterior surface of the at least one detachable cap, and a cavity beneath the lip, and a tether for retaining the at least one detachable cap such that the at least one detachable cap is operatively coupled to the helmet when detached, wherein the tether is attached to the at least one detachable cap and to the protective shell.

15. The helmet of claim 14, wherein one of the at least one detachable cap or the helmet has a first magnet, and the other of the at least one detachable cap or helmet has a ferrous member or a second magnet, positioned so that the first magnet and the ferrous member or second magnet holds the at least one detachable cap in the at least one opening.

16. The helmet of claim 14, further comprising a ledge formed in the exterior shell in the at least one opening, wherein the inner diameter of the ledge is smaller than the inner diameter of the at least one opening.

17. The helmet of claim 14, wherein the at least one opening is circular, further comprising a circular ring covering a sidewall of the at least one opening.

18. The helmet of claim 14, further comprising one or more air channels extending between two or more of the plurality of vents.

19. The helmet of claim 14, further comprising an air scoop attached to the protective shell at one of the plurality of vents.

20. The helmet of claim 19, wherein the air scoop is detachable from the protective shell.

* * * * *